US009399224B2

(12) United States Patent
Brodt

(10) Patent No.: US 9,399,224 B2
(45) Date of Patent: Jul. 26, 2016

(54) UNDERWATER MINERAL SORTING METHODS AND SYSTEMS

(71) Applicant: S.G.B.D. TECHNOLOGIES LTD., Haifa (IL)

(72) Inventor: Alexander Brodt, Beer Sheva (IL)

(73) Assignee: S.G.B.D. TECHNOLOGIES LTD., Haifa (IL)

( * ) Notice: Subject to any disclaimer, the term of this patent is extended or adjusted under 35 U.S.C. 154(b) by 0 days.

(21) Appl. No.: 13/950,325

(22) Filed: Jul. 25, 2013

(65) Prior Publication Data

US 2015/0021237 A1 Jan. 22, 2015

(30) Foreign Application Priority Data

Jul. 18, 2013 (IL) ..... 227551

(51) Int. Cl.

| | |
|---|---|
| ***B03B 5/00*** | (2006.01) |
| ***B03B 5/28*** | (2006.01) |
| ***B03B 5/38*** | (2006.01) |
| ***B03B 5/44*** | (2006.01) |
| ***B03B 11/00*** | (2006.01) |

(52) U.S. Cl.

CPC ... *B03B 5/28* (2013.01); *B03B 5/38* (2013.01); *B03B 5/44* (2013.01); *B03B 11/00* (2013.01); *B03B 2011/008* (2013.01)

(58) Field of Classification Search

CPC ..... B03B 5/28; B03B 5/30
USPC ..... 209/172–174, 192, 194
See application file for complete search history.

(56) References Cited

U.S. PATENT DOCUMENTS

| | | | | |
|---|---|---|---|---|
| 1,294,519 | A * | 2/1919 | Moxham | 209/172 |
| 1,524,838 | A * | 2/1925 | Muller | 209/172.5 |
| 1,839,117 | A * | 12/1931 | Nagelvoort | 209/172 |
| 3,098,735 | A | 7/1963 | Clark | |
| 3,368,362 | A | 2/1968 | Clark et al. | |
| 3,399,538 | A | 9/1968 | Sliepcevich et al. | |
| 3,442,801 | A | 5/1969 | Anderson | |

(Continued)

FOREIGN PATENT DOCUMENTS

| | | |
|---|---|---|
| RU | 2043500 | 9/1995 |
| WO | WO-8707250 | 12/1987 |
| WO | WO 2009/061556 | 5/2009 |

OTHER PUBLICATIONS

Israeli Office Action of Application No. 227551 dated Feb. 6, 2014.

(Continued)

*Primary Examiner* — Thomas Morrison
(74) *Attorney, Agent, or Firm* — Pearl Cohen Zedek Latzer Baratz LLP

(57) ABSTRACT

Provided are systems and methods for sorting crushed material by gravitationally separating components of the crushed material according to component densities in a liquid column having a bottom layer of a heavy water-immiscible liquid, an intermediate layer of an aqueous salt solution and a top layer of a light water-immiscible liquid. The heavy water-immiscible liquid has a higher density than the aqueous salt solution, the aqueous salt solution has a higher density than the light water-immiscible liquid and the light water-immiscible liquid has a higher density than sea water to maintain the intermediate layer on top of the bottom layer, the top layer on top of the intermediate layer and the top layer in the liquid column.

18 Claims, 3 Drawing Sheets

(56) References Cited

U.S. PATENT DOCUMENTS

| | | | | |
|---|---|---|---|---|
| 4,111,798 | A * | 9/1978 | Peterson et al. | 209/172.5 |
| 4,232,903 | A | 11/1980 | Welling | |
| 4,666,484 | A | 5/1987 | Shah et al. | |
| 6,003,952 | A | 12/1999 | Smart et al. | |
| 7,875,123 | B2 | 1/2011 | Crawford | |
| 8,842,956 | B2 * | 9/2014 | O'Riorden et al. | 385/109 |
| 2003/0117150 | A1 * | 6/2003 | Noik et al. | 324/639 |
| 2012/0257863 | A1 * | 10/2012 | O'Riorden et al. | 385/109 |
| 2013/0134102 | A1 | 5/2013 | Buchsbaum | |

OTHER PUBLICATIONS

Search Report of International Application No. PCT/IL2014/050582 dated Oct. 19, 2014.

E.A. Velichko, E.A. Kontar', O.K. Tareeva "Ore from Oceanic Depths", Moscow: "Nedra", 1980, Chapter 8, pp. 69-86.

* cited by examiner

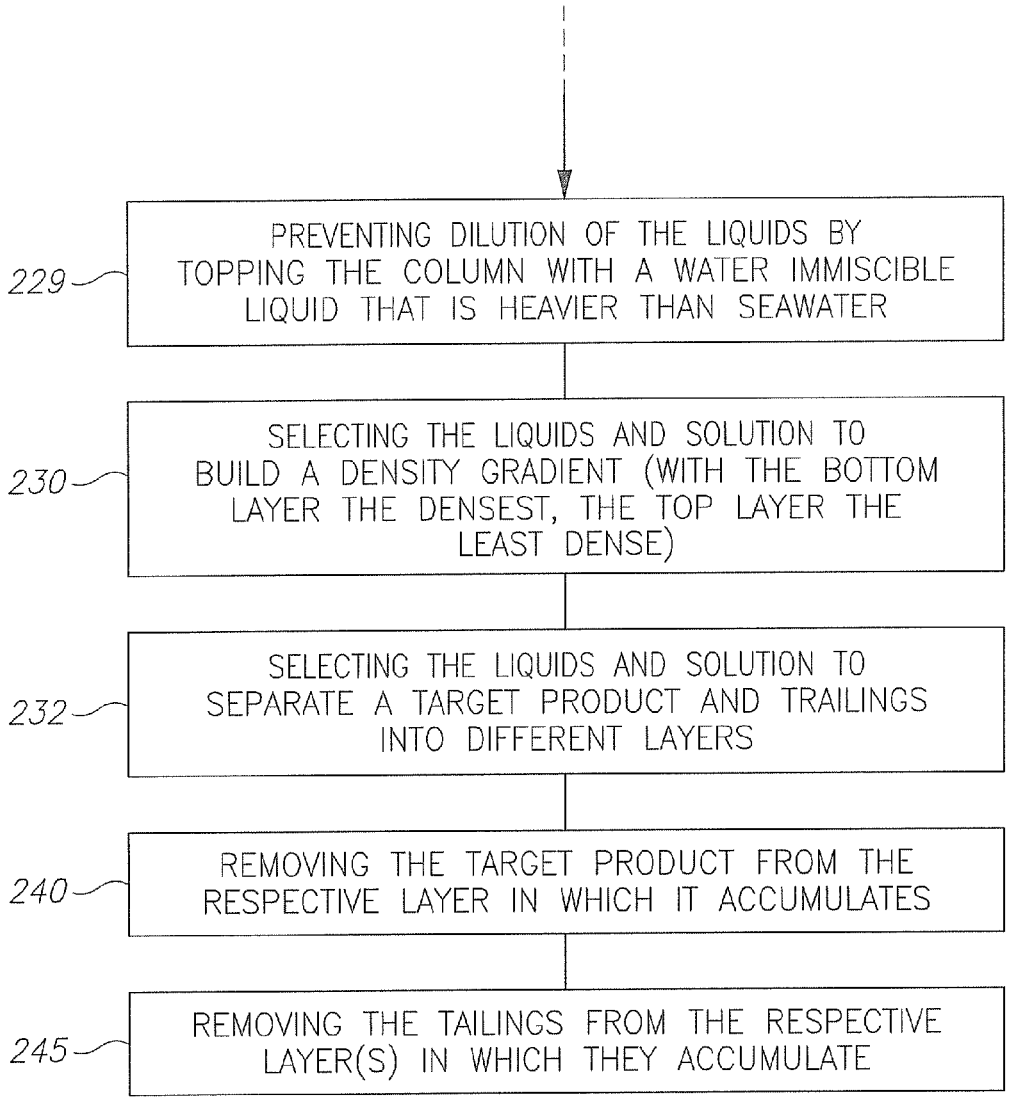
Figure 2 (cont. 1)

UNDERWATER MINERAL SORTING METHODS AND SYSTEMS

CROSS REFERENCE TO RELATED APPLICATIONS

This application claims the benefit of Israeli Patent Application No. 227551, filed on Jul. 18, 2013, which is incorporated herein by reference in its entirety.

BACKGROUND OF THE INVENTION

1. Technical Field

The present invention relates to the field of mineral production, and more particularly, to underwater mineral sorting.

2. Discussion of Related Art

Mineral production requires sorting the mineral ores from the rock material in which they are embedded. When producing minerals underwater, it is not efficient to deliver all the material to the shore for processing, as most material is not needed and creates environmental problems.

SUMMARY OF THE INVENTION

One aspect of the present invention provides systems and methods for sorting crushed material by gravitationally separating components of the crushed material according to component densities in a liquid column comprising at least a bottom layer of a heavy water-immiscible liquid, an intermediate layer of an aqueous salt solution and a top layer of a light water-immiscible liquid. The heavy water-immiscible liquid is selected to have a higher density than the aqueous salt solution, the aqueous salt solution is selected to have a higher density than the light water-immiscible liquid and the light water-immiscible liquid is selected to have a higher density than sea water to maintain the intermediate layer on top of the bottom layer, the top layer on top of the intermediate layer and the top layer in the liquid column.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

For a better understanding of embodiments of the invention and to show how the same may be carried into effect, reference will now be made, purely by way of example, to the accompanying drawings in which like numerals designate corresponding elements or sections throughout.

In the accompanying drawings.

DETAILED DESCRIPTION OF THE INVENTION

Figure 1:
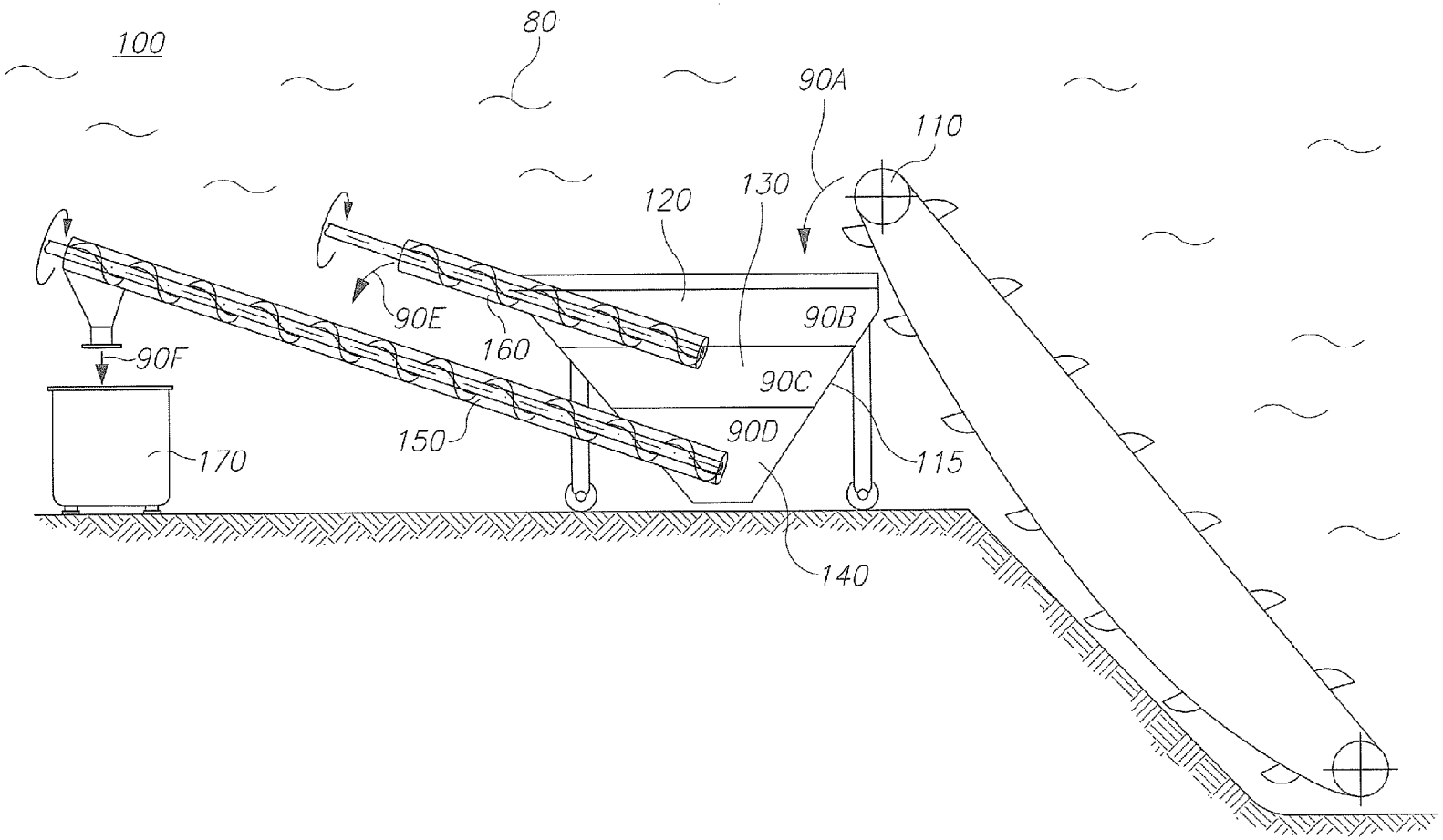
FIG. 1 is a high level schematic block diagram of an underwater crushed material sorting unit that is part of an underwater mineral production system, according to some embodiments of the invention.

Prior to the detailed description being set forth, it may be helpful to set forth a definition of the term "gradient" as used in this application, which refers to a monotonous increase which may be continuous or step-wise. As an example, a liquid density gradient may comprise a gradual increase in density or several layers, each layer with a higher density than the layer above it.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 is a high level schematic block diagram of an underwater crushed material sorting unit 101 that is part of an underwater mineral production system 100, according to some embodiments of the invention.

Underwater crushed material sorting unit 101 comprises a container 115 comprising a bottom layer 140 of a heavy water-immiscible liquid, an intermediate layer 130 of an aqueous salt solution and a top layer 120 of a light water-immiscible liquid.

In certain embodiments, the heavy water-immiscible liquid is selected to have a higher density than the aqueous salt solution, the aqueous salt solution is selected to have a higher density than the light water-immiscible liquid, and the light water-immiscible liquid is selected to have a higher density than sea water to maintain intermediate layer 130 on top of bottom layer 140, top layer 120 on top of intermediate layer 130 and top layer 120 within container 115.

Container 115 is arranged to receive crushed material 90A having a weight distribution. Without being bound by theory, topping the liquid column, composed of layers 120, 130, 140, by top layer 120 which is water-immiscible and heavier than seawater prevents mixing of layer 120 with seawater, ensures than the liquid column stays undiluted and within container 115 and also removes seawater from delivered crushed material 90A.

Underwater crushed material sorting unit 101 further comprises at least one discharger (e.g., dischargers 150, 160) arranged to remove at least one respective part (e.g., 90F, 90E respectively) of the material from at least one respective layer (e.g., 140, 130 respectively). For example, unit 101 may comprise a first discharger 160 arranged to remove a first part 90E of the material (90C) from intermediate layer 130; and a second discharger 150 arranged to remove a second part 90F of the material (90D) from bottom layer 140.

Without being bound by theory, the densities of light water-immiscible liquid, aqueous salt solution and heavy water-immiscible liquid determine which parts 90B, 90C, 90D (respectively) of delivered crushed material 90A accumulate in each layer 120, 130, 140 respectively.

In certain embodiments, the liquids and solution may be selected to separate a target product and tailings into different layers in container 115. For example, if the product is heavier than tailings, the liquids and solution may be selected to accumulate the product in a different and lower level than the layer in which tailings accumulate. For example, the target product may accumulate as part 90D in bottom layer 140, while the tailings may accumulate as parts 90C and 90B and be left in intermediate and top layers 130, 120 respectively in container 115.

In certain embodiments, the aqueous salt solution may comprise aqueous solutions of various mineral salts and mixtures thereof, which have a density that is sufficient for waste rock floating, for example, aqueous solution of sodium or potassium silicone-tungstate, or generally an alkali metal silicone-tungstate.

In certain embodiments, the light water-immiscible liquid has a density that is intermediate between that of the waste rock and sea water, for example, phthalic acid dibutyl ether (dibutylphthalate, density 1.05 g/cm$^3$) or a mixture of various individual organic compounds (e.g., hexane mixture with perfluorocyclobutane). Light water-immiscible liquid may thus be used as a non-aqueous layer screening the water-salt solution from the seawater.

In certain embodiments, the heavy water-immiscible liquid has a density that exceeds the density of the aqueous salt solution. For example, the heavy water-immiscible liquid may comprise bromoform ($CHBr_3$, a small amount of this substance is even synthesized by algae in the ocean), tetrabromoethane ($C_2H_2Br_4$), tribromofluoromethane ($CBr_3F$), pentabromofluoroethane ($C_2Br_5F$) or their mixtures.

Generally, other chemically inert halogenated organic compounds with appropriate rheological, thermodynamic and hygiene and sanitary properties according to specifications may be used as either water-immiscible liquids.

In certain embodiments, underwater mineral production system 100 may comprise at least one underwater crushed material sorting unit 101, at least one underwater dredge 110 arranged to deliver crushed material 90A to at least one underwater crushed material sorting unit 101, and at least one target product container 170 arranged to receive at least one respective part 90F of delivered crushed material 90A. In system 100, the liquids and solution may be selected to concentrate a target product in bottom layer 140 and leave tailings in intermediate and top layers 130, 120 in container 115, wherein target product container 170 is arranged to receive target product 90F.

Advantageously, the present invention expands the range of processable mineral sources by enabling their gravitational differentiation from waste rock in which they are embedded, increases the process productivity, reduces power consumption and prevents removal of heavy water-salt medium out of the technological process.

In certain embodiments, system 100 is used to stratify ripped raw material deposits from the sea bottom in a water-salt medium with a density that exceeds that of sea water. The rock mass is taken from the sea bottom and delivered for stratification into a water-salt medium (layer 130) through top layer 120 of a screening water-immiscible non-aqueous liquid with the density intermediate between those of the water-salt medium and sea-water. Meanwhile, the removal of sunken material is realized through bottom layer 140 of another immiscible non-aqueous underlying liquid with a higher density.

Advantageously, isolation of the heavy water-salt medium from both below and above by layers of non-aqueous liquids immiscible with sea water protects the working water-salt medium from dilution by sea water introduced into the process with the initial raw material. Additionally, the isolation of the heavy water-salt medium from both below and above by layers of non-aqueous liquids immiscible with sea water prevents the removal of working liquid, in which the sorting process takes place, together with sorting products. The illustrated process is continuous, because it is not necessary to lift the container with water-salt medium on board of the commercial ship every time it is filled, and allows the production of minerals, whose density exceeds that of the waste rock, from the sea bottom. The disclosed processes and systems may further enable the production of especially valuable kinds of raw minerals with the same productivity with respect to the initial rock mass independently of the production depth and valuable component content in the ore.

EXAMPLE

In a non-limiting example, rock mass delivered by underwater dredge 110 is submerged through layer 120 of water-immiscible non-aqueous liquid (in a non-limiting example, a mixture of hexane with perfluorocyclobutane density 1.05 g/cm3) into layer 130 of heavy water-salt medium (in a non-limiting example, aqueous solution of sodium silicon-tungstate, density 2.78 g/cm$^3$), where the component minerals are stratified into light (e.g., part 90B as final tailings) and heavy (e.g., part 90C as concentrated material) fractions. After the settling fraction 90C passes layer 130 of the heavy water-salt medium, the target product (e.g., part 90D) submerges further into layer 140 of water-immiscible liquid, even heavier organic liquid (in a non-limiting example, bromoform, density 2.89 g/cm3) and then is taken out of the process though a sea-water layer using screw discharger 150 as 90F. During the removal of product 90D, heavy organic liquid on the surface of the solid material may be substituted by sea-water and thus maintained within layer 140 in container 115. Similarly, the light fraction 90B representing final tailings may also be taken out of the stratification process using screw discharger 160, and then arranged in the worked-out space as 90E. Due to the high density of the salt solution in layer 130, layer 130 too stays within intermediate layer 130 and container 115 and does not mix with sea water or dilute. In other embodiments, however, parts of any of the liquids and solution may be regularly refreshed or replaced. The ready product (90F in this non-limiting example) may be reloaded into target product container 170 to be delivered on board of the commercial ship.

In certain embodiments, either some or all of layers 120, 130, 140 may comprise a density gradient to enhance and refine the separation efficiency of the delivered rock mass. In certain embodiments, the density of either some or all of layers 120, 130, 140 may be constant.

Without being bound by theory, heavy water-salt medium in intermediate layer 130, being isolated on both sides by layers 120, 140 of water-immiscible organic liquids of respective densities, is practically not consumed in such a process, although it may be mixed, in some embodiments, with sea-water in any ratio.

Figure 2:
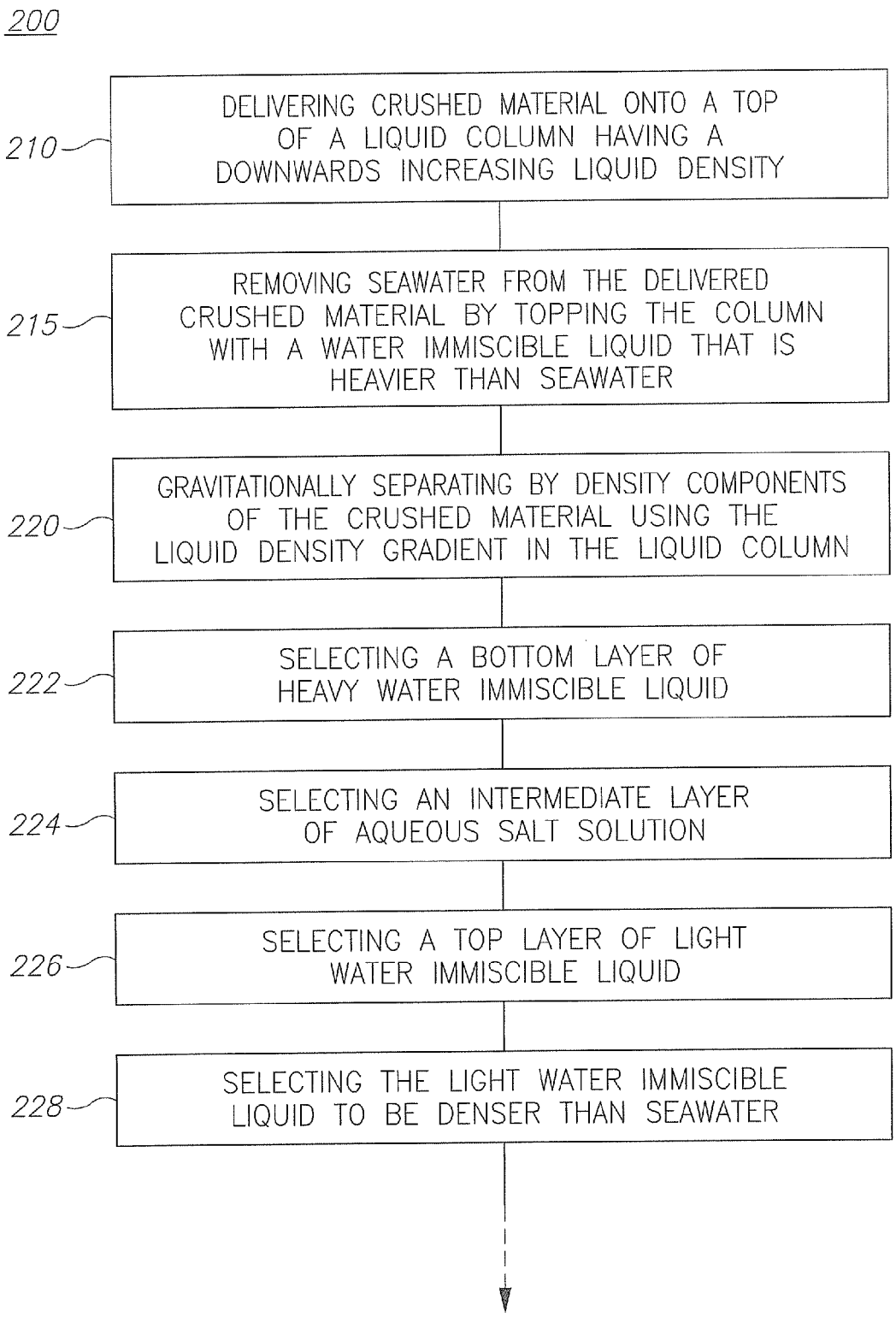
FIG. 2 is a high level schematic illustration of an underwater mineral production method, according to some embodiments of the invention.

FIG. 2 is a high level schematic illustration of an underwater mineral production method 200, according to some embodiments of the invention. Method 200 enables underwater sorting of crushed material by gravitationally separating by density components of the crushed material using a liquid column having a downwards increasing density (stage 220). Method 200 may comprise delivering the crushed material onto a top of the liquid column having a downwards increasing liquid density (stage 210).

The liquid column may comprise at least a bottom layer of a heavy water-immiscible liquid, an intermediate layer of an aqueous salt solution and a top layer of a light water-immiscible liquid. The heavy water-immiscible liquid may be selected to have a higher density than the aqueous salt solution, the aqueous salt solution may be selected to have a higher density than the light water-immiscible liquid and the light water-immiscible liquid may be selected to have a higher density than sea water. The downwards increasing density, with heavier liquids deeper in the column and alternating water affinity, is configured to maintain the intermediate layer on top of the bottom layer, the top layer on top of the intermediate layer and the top layer in the liquid column.

In particular, method 200 comprises selecting a bottom layer of a heavy water-immiscible liquid (stage 222), selecting an intermediate layer of an aqueous salt solution (stage 224), selecting a top layer of a light water-immiscible liquid (stage 226), selecting the light water-immiscible liquid to be denser than seawater (stage 228) and selecting the liquids and solutions to build a density gradient (with the bottom layer the densest, the top layer the least dense) (stage 230).

Moreover, without being bound by theory, the higher-than-seawater density of the light water-immiscible liquid is useful in preventing dilution of the liquids (stage 229) and in removing seawater from the delivered crushed material (stage 215). Both benefits are achieved by topping the column with a water-immiscible liquid that is heavier than seawater In certain embodiments, method 200 may comprise selecting the liquids and solution to separate a target product and trailings into different layers (stage 232), removing the target product from the respective layer in which it accumulates (stage 240) and removing the tailings from the respective layer(s) in which they accumulates (stage 245). For example, if the product is heavier than the tailings (e.g., gold ore and silicate tailings), the layers may be selected to accumulate the product in a lower layer, e.g., the bottom layer, while accumulating the tailings in a higher layer, e.g., the intermediate layers. The product and tailings may be removed from the respective layers at rates that correspond to their accumulation speeds. The form of the container holding the liquid column may be designed to permit respective volumes of product and tailings to accumulate and be removed.

In certain embodiments, method 200 of underwater mineral production may comprise ripping of the original raw minerals deposits on the sea bottom with subsequent excavation of the obtained rock mass and its stratification into mineral components of the original raw material in a heavy water-salt medium with the density exceeding that of sea-water. The rock mass scooped from the sea bottom is fed for stratification into the water-salt medium through a screening layer of water-immiscible non-aqueous layer, whose density is intermediate between the former and sea-water, whereas the sunken material is discharged through a layer of another underlying liquid with a superior density, immiscible with the aqueous medium. In non-limiting examples, sodium silicontungstate solution in water may be used as a heavy water-salt medium with the density intermediate between the target and waste components of the initial raw material. A mixture of hexane with perfluorocyclobutane may be used as a water-immiscible non-aqueous organic liquid screening the layer of heavy water-salt medium, through which layer the initial rock mass is submerged for the stratification of its component minerals. Bromoform may be used as a water-immiscible non-aqueous organic liquid underlying the layer of heavy water-salt medium, from which the submerged fraction of the target component of the original raw material is discharged.

In certain embodiments, method 200 may be realized by ripping and excavation of rock deposits lying on the sea bottom; transfer of the ripped rock mass roiled in sea-water into a movable container filled with a three-layer column of immiscible liquids with densities exceeding that of the sea-water; transfer of rock mass suspension in sea-water through the upper layer of non-aqueous liquid screening the layer of the working water-salt medium with a simultaneous displacement of the sea water wetting the surface of minerals that form the initial raw material by the non-aqueous liquid; stratification of minerals forming the rock mass in a water-salt working medium into a light (waste rock) and heavy (valuable component) fractions with a simultaneous displacement of residues of non-aqueous liquid (wetting them after they pass the upper layer of non-aqueous liquid) from their surface; valuable component discharge from the layer of heavy non-aqueous liquid underlying the working water-salt medium, through the sea water flooding the discharge facility; and waste rock discharge through the layer of light non-aqueous liquid screening the working water-salt medium, with a simultaneous substitution of non-aqueous liquids wetting the surface of the discharged minerals with sea-water; and delivery of the valuable component wetted by sea water on board of the commercial ship and waste rock arrangement in the worked-out space.

Advantageously, the use of method 200 may have a number of economic advantages over known technologies of underwater minerals production, since method 200 ensures the technical possibility to separate valuable minerals from waste rock immediately at the sea bottom, even if we are dealing with the production of raw ores, which allows us to avoid the delivery of the whole volume of the produced rock mass on board of the commercial ship from the sea depth, as well as permanent replenishment of the system with fresh water-salt medium with the density exceeding that of the waste rock.

In the above description, an embodiment is an example or implementation of the invention. The various appearances of "one embodiment", "an embodiment", "certain embodiments" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Certain embodiments of the invention may include features from different embodiments disclosed above, and certain embodiments may incorporate elements from other embodiments disclosed above. The disclosure of elements of the invention in the context of a specific embodiment is not to be taken as limiting their used in the specific embodiment alone.

Furthermore, it is to be understood that the invention can be carried out or practiced in various ways and that the invention can be implemented In certain embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. An underwater crushed material sorting unit comprising:

a container containing a bottom layer of a heavy water-immiscible liquid, an intermediate layer of an aqueous salt solution and a top layer of a light water-immiscible liquid, wherein the heavy water-immiscible liquid is selected to have a higher density than the aqueous salt solution, the aqueous salt solution is selected to have a higher density than the light water-immiscible liquid and the light water-immiscible liquid is selected to have a higher density than sea water to maintain the intermediate layer on top of the bottom layer, the top layer on top of the intermediate layer and the top layer within the container, and wherein the container is arranged to receive crushed material having a weight distribution; and at least one discharger arranged to remove at least one respective part of the material from at least one respective layer.

2. The underwater crushed material sorting unit of claim 1, wherein the liquids and solution are selected to separate a target product and trailings into different layers in the container.

3. The underwater crushed material sorting unit of claim 1, wherein the at least one discharger comprises:

a first discharger arranged to remove a first part of the material from the intermediate layer; and a second discharger arranged to remove a second part of the material from the bottom layer.

4. The underwater crushed material sorting unit of claim 3, wherein the liquids and solution are selected to concentrate a target product in the bottom layer and leave trailings in the intermediate and top layers in the container.

5. An underwater mineral production system comprising:

at least one underwater crushed material sorting unit of claim 1;

at least one underwater dredge arranged to deliver crushed material to the at least one underwater crushed material sorting unit; and at least one target product container arranged to receive the at least one respective part of the material.

6. The underwater mineral production system of claim 5, wherein the liquids and solution are selected to concentrate a target product in the bottom layer and leave trailings in the intermediate and top layers in the container, and wherein the target product container is arranged to receive the target product.

7. The underwater mineral production system of claim 6, wherein the heavy water-immiscible liquid comprises at least one of: bromoform, tetrabromoethane, tribromofluoromethane, pentabromofluoroethane and mixtures thereof.

8. The underwater mineral production system of claim 6, wherein the aqueous salt solution comprises an alkali metal silicone-tungstate.

9. The underwater mineral production system of claim 6, wherein the light water-immiscible liquid comprises at least one of: dibutylphthalate, hexane, perfluorocyclobutane and mixtures thereof.

10. A method of underwater sorting of crushed material, the method comprising:

gravitationally separating components of the crushed material according to component densities in a liquid column comprising at least a bottom layer of a heavy water-immiscible liquid, an intermediate layer of an aqueous salt solution and a top layer of a light water-immiscible liquid, wherein the heavy water-immiscible liquid is selected to have a higher density than the aqueous salt solution, the aqueous salt solution is selected to have a higher density than the light water-immiscible liquid and the light water-immiscible liquid is selected to have a higher density than sea water to maintain the intermediate layer on top of the bottom layer, the top layer on top of the intermediate layer and the top layer in the liquid column.

11. The method of claim 10, further comprising delivering the crushed material onto a top of the column.

12. The method of claim 10, further comprising selecting the liquids and solution to separate a target product and trailings into different layers.

13. The method of claim 12, further comprising removing the target product from the respective layer in which it accumulates.

14. The method of claim 12, further comprising removing tailings from at least one respective layer in which they accumulate.

15. The method of claim 12, further comprising selecting the liquids and solution to concentrate the target product in the bottom layer and leave the trailings in the intermediate and top layers in the container, and wherein a target product container is arranged to receive the target product.

16. The method of claim 15, wherein the heavy water-immiscible liquid comprises at least one of: bromoform, tetrabromoethane, tribromofluoromethane, pentabromofluoroethane and mixtures thereof.

17. The method of claim 15, wherein the aqueous salt solution comprises an alkali metal silicone-tungstate.

18. The method of claim 15, wherein the light water-immiscible liquid comprises at least one of: dibutylphthalate, hexane, perfluorocyclobutane and mixtures thereof.

* * * * *